US007185637B1

(12) United States Patent
Yanagisawa et al.

(10) Patent No.: US 7,185,637 B1
(45) Date of Patent: Mar. 6, 2007

(54) FUEL INJECTION CONTROL METHOD AND FUEL INJECTION CONTROL APPARATUS FOR ENGINE

(75) Inventors: Naoaki Yanagisawa, Kanagawa-ken (JP); Tsutomu Murakami, Kanagawa-ken (JP)

(73) Assignee: Nikki Co., Ltd. (JP)

( * ) Notice: Subject to any disclaimer, the term of this patent is extended or adjusted under 35 U.S.C. 154(b) by 0 days.

(21) Appl. No.: 11/357,038

(22) Filed: Feb. 21, 2006

(30) Foreign Application Priority Data

Sep. 9, 2005 (JP) ..... 2005-262265

(51) Int. Cl.
*F02M 51/00* (2006.01)
*F02M 51/08* (2006.01)

(52) U.S. Cl. ..... 123/492; 123/682

(58) Field of Classification Search ..... 123/478, 123/480, 492, 681, 682, 683, 684; 73/119 A
See application file for complete search history.

(56) References Cited

U.S. PATENT DOCUMENTS 6,598,469 B2 * 7/2003 Shimoyama et al. ..... 73/117.3
6,997,167 B2 * 2/2006 Kitagawa et al. ..... 123/492
2005/0133011 A1 * 6/2005 Kitagawa et al. ..... 123/492

FOREIGN PATENT DOCUMENTS

JP 2002-242749 8/2002

* cited by examiner

*Primary Examiner*—Mahmoud Gimie
(74) *Attorney, Agent, or Firm*—Rader, Fishman & Grauer PLLC

(57) ABSTRACT

In a fuel injection control method of an engine, an electronic control unit calculates a pressure integrated value for one combustion cycle by detecting a combustion cycle and continuously detecting a suction air pipe pressure and determines that the engine is under an accelerated state such that a pressure difference determined by comparing the pressure integrated value with the pressure integrated value at the preceding combustion cycle becomes equal to or more than a predetermined acceleration determining reference value, thereby increasing a fuel amount. The electronic control unit determines that the engine is under the accelerated state at a particular time when the difference between the pressure integrated value and the atmospheric pressure becomes equal to or less than a reference value and a pressure difference integrated value obtained by integrating each of the pressure differences within an integrating period becomes equal to or more than another reference value.

3 Claims, 4 Drawing Sheets

FUEL INJECTION CONTROL METHOD AND FUEL INJECTION CONTROL APPARATUS FOR ENGINE

BACKGROUND OF THE INVENTION

1. Field of the Invention

The present invention relates to a method of executing a fuel injection control by detecting an acceleration state of an engine, and a fuel injection control apparatus, and more particularly, to a fuel injection control method and a fuel injection control apparatus which determines an acceleration state at a predetermined level or more for executing an accurate air-fuel ratio control so as to execute a fuel injection control.

2. Description of the Related Art

In recent years, a fuel supply system of an engine is generally provided with a fuel injection control apparatus and controlled in such a manner as to inject a fuel in correspondence to an air amount sucked into a combustion chamber on the basis of data detected by various monitors. However, in a transient state such as a rapid accelerating time or the like, it becomes frequently hard to keep an air-fuel ratio of an air-fuel mixture optimum due to a detection delay of a suction air amount and a time lag until a feed of the fuel injected into a suction pipe reaches a combustion chamber.

Accordingly, in order to make the fuel injection control apparatus detect the transient state mentioned above without delay so as to execute an increase of the injection fuel, there has been employed a method of determining this on the basis of a fluctuation of a throttle opening degree by using a throttle valve opening degree sensor. However, if the throttle opening degree sensor is provided in a fuel supply system, a manufacturing cost is largely increased, so that the structure tends to be disadvantageous in a view of a cost.

On the other hand, there is a method of determining the transient state of the engine on the basis of a fluctuation of a suction pipe pressure by arranging a pressure sensor in the suction air pipe. In this case, in order to do away with an influence of a pulsation within the suction air pipe, there has been executed a determination by integrating the suction air pipe pressure over one combustion cycle and comparing with an integrated value of the suction air pipe pressure in the preceding one combustion cycle.

Further, in Japanese Unexamined Patent Publication No. 2002-242749, there is proposed a method of determining a transient state of an engine by defining a plurality of angle positions about a rotating angle of a crank shaft of the engine as sampling positions of a suction air pipe pressure, storing each of the suction air pipe pressures sampled at each of the sampling positions, and comparing the suction air pipe pressure sampled at the same position as the position at one cycle before every samplings. Accordingly, the structure is not affected by the influence of the pulsation within the suction air pipe is prevented, and tends to immediately correspond to a generation of the transient state.

However, there is a case that the suction air pipe pressure is increased in spite that a compared difference of the suction air pipe pressure is small, for example, a case that a slow acceleration is executed or the like. Accordingly, in the determining method mentioned above, in the case that the rapid acceleration is executed in a condition that the suction air pipe pressure is increased, the pressure difference does not become large in spite that a practical suction air amount is increased, so that the accelerated state is not determined. Accordingly, there is a defect that an amount of the fuel is not increased and the air-fuel ratio becomes lean, so that a trouble such as a breathing or the like is generated.

SUMMARY OF THE INVENTION

An object of the present invention is to solve the problem mentioned above and to provide a method of executing a fuel injection control by detecting a fluctuation of a suction air pipe pressure so as to determine an acceleration state and a fuel injection control apparatus, in which it is possible to control to an optimum air-fuel ratio by securing determining the acceleration state without generating an excessive increase of a cost, even in the case that the acceleration state is hard to be detected only on the basis of a pressure difference of the suction air pipe.

In accordance with the present invention, there is provided a fuel injection control method for an engine in which an electronic control unit calculating a pressure integrated value for one combustion cycle by detecting a combustion cycle by a crank angle detecting means and continuously detecting a suction air pipe pressure by a suction air pipe pressure detecting means determines that the engine is under an accelerated state in the case that a pressure difference determined by comparing the pressure integrated value with the pressure integrated value at the preceding time becomes equal to or more than a predetermined acceleration determining reference value, thereby increasing a fuel amount, wherein the fuel supply system is provided with an atmospheric pressure detecting means, and executes an acceleration determination that the engine is under the accelerated state in the electronic control unit in the case that a difference between the pressure integrated value and the atmospheric pressure detected by the atmospheric pressure detecting means is equal to or less than a predetermined reference value, and a pressure difference multiplied value obtained by multiplying the pressure difference within a predetermined multiplying period including this time combustion cycle is equal to or more than a predetermined reference value, even if the calculated pressure value is less than the acceleration determining reference value.

Accordingly, even under a condition in which a transient state is hard to appear in the pressure difference, such as a case that a rapid acceleration is executed in succession to a slow acceleration, it is possible to accurately determine whether or not the accelerated state is an accelerated state to be corresponded to, by combining two scales comprising a comparison between a pressure integrated value of the suction air pipe and the atmospheric pressure and an increase level of the suction air pipe pressure by the pressure difference integrated value. Accordingly, it is possible to easily achieve an optimum air-fuel ratio control.

Further, in the fuel injection control method of the engine, if the calculation of the fuel injection amount in the case that the electronic control unit determines the accelerated state is executed in accordance with a predetermined calculating method on the basis of the pressure difference integrated value at a time point when the acceleration is determined, the pressure difference integrated value reflects the accelerated condition, and it is easy to calculate an optimum fuel injection amount.

Further, in accordance with a fuel injection control apparatus for an engine comprising an electronic control unit in which a program for executing the fuel injection control method of the engine mentioned above is stored in a memory means, wherein the fuel injection control apparatus is incorporated in the fuel supply system of the engine mentioned above so as to execute the fuel injection control method, it is possible to determine all the accelerated states so as to easily achieve an appropriate air-fuel ratio control, only by incorporating in an existing fuel supply system of a 4-cycle engine.

In accordance with the present invention structured such that the acceleration determination is executed by combining two scales comprising the comparison between the pressure integrated value of the suction air pipe and the atmospheric air pressure and the increase level of the suction air pipe pressure on the basis of the pressure difference integrated value, it is possible to securely determine the accelerated state without accompanying an excessive increase of a cost so as to control to an optimum air-fuel ratio, even in the case that the accelerated state is hard to be detected by the pressure difference of the suction air pipe such as a case that the rapid acceleration is executed in succession to the slow acceleration.

DESCRIPTION OF THE PREFERRED EMBODIMENTS

Figure 1:
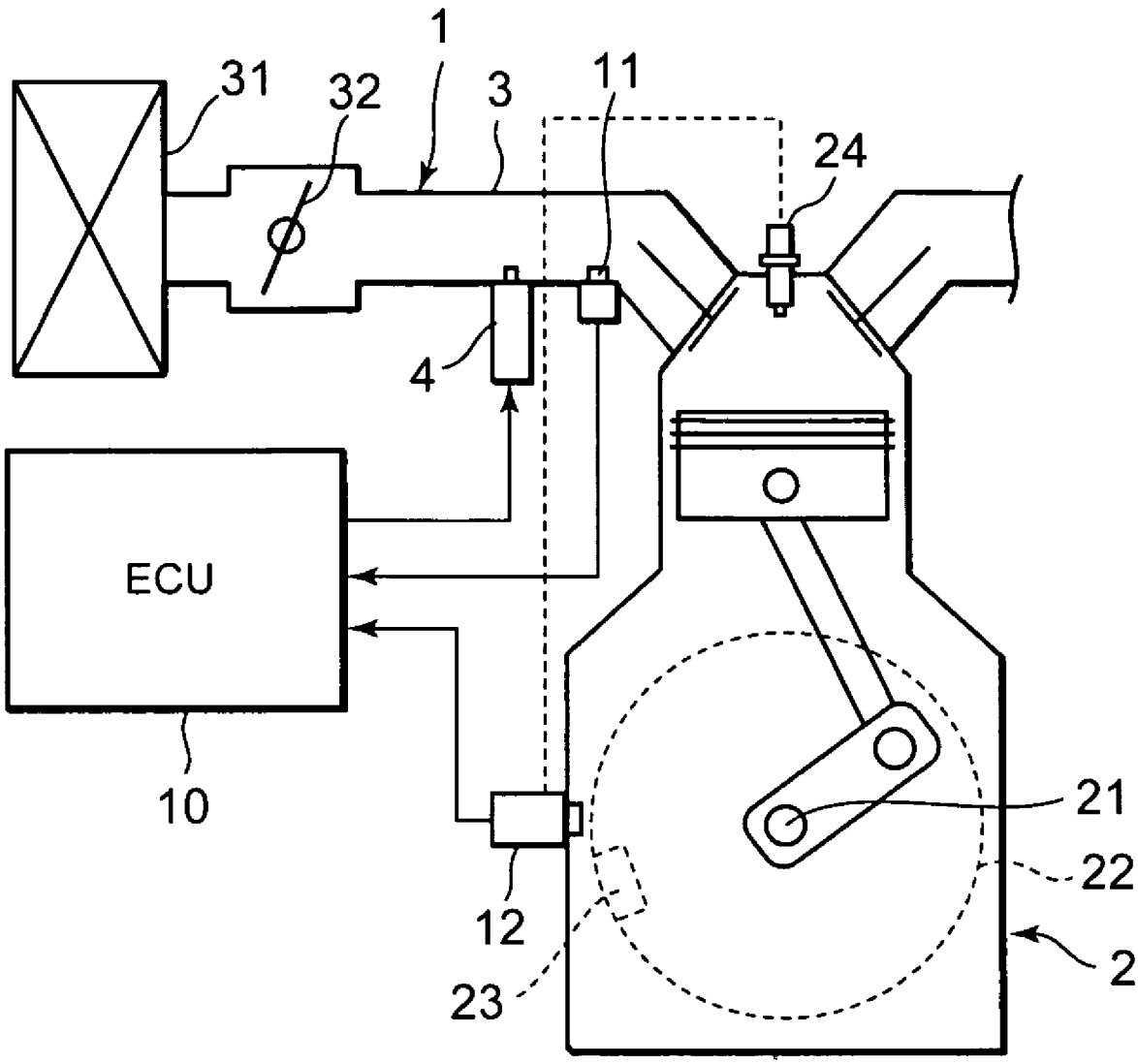
FIG. 1 is an arrangement view showing an embodiment in accordance with the present invention.

A description will be given of an embodiment in accordance with the present invention with reference to the accompanying drawings. FIG. 1 is an arrangement view showing a state in which a fuel supply system 1 provided with an electronic control unit 10 serving as a fuel injection control apparatus for an engine in which a program for executing a fuel injection control method of the engine in accordance with the present invention is stored is mounted on an engine 2. A suction air pipe 3 in the fuel supply system 1 is provided with an air cleaner 31 in an inlet, a throttle valve 32 is arranged in a downstream side of the suction air pipe 3, and a fuel injection valve 4 is arranged in a downstream side of the throttle valve 32.

The electronic control unit 10 corresponds to a general-purpose electronic control unit provided with CPU, ROM and RAM which are not illustrated, and is structured such that output signals from a pressure sensor 11 installed in the suction air pipe 3 and continuously detecting a suction air pipe pressure and an ignition coil 12 are input.

The engine 2 corresponds to a one-cylinder four-cycle engine, is provided with magnets 23 at predetermined positions in a peripheral edge of a flywheel 22 attached to a crank shaft 21, and is structured such that the ignition coil 12 is arranged close to the engine, and a secondary voltage generated in a secondary coil of the ignition coil 12 generates a spark in an ignition coil 24 on the basis of a rotation of the crank shaft 21.

Further, the structure is made such that a primary voltage generated in a primary coil of the ignition coil 12 is input as a crank angle detection signal to the electronic control unit 10. In other words, a rotation angle of the crank shaft 21 in one combustion cycle is 720 degree (two rotations) in the four-cycle engine, and the ignition coil 12 generates an ignition signal per 360 degree. The ignition signal is detected as a crank angle position during one combustion cycle such as 0 degree, 360 degree 720 degree (0 degree). Further, the electronic control unit 10 calculates an engine speed on the basis of the crank angle position detected per 360 degree.

Figure 2:
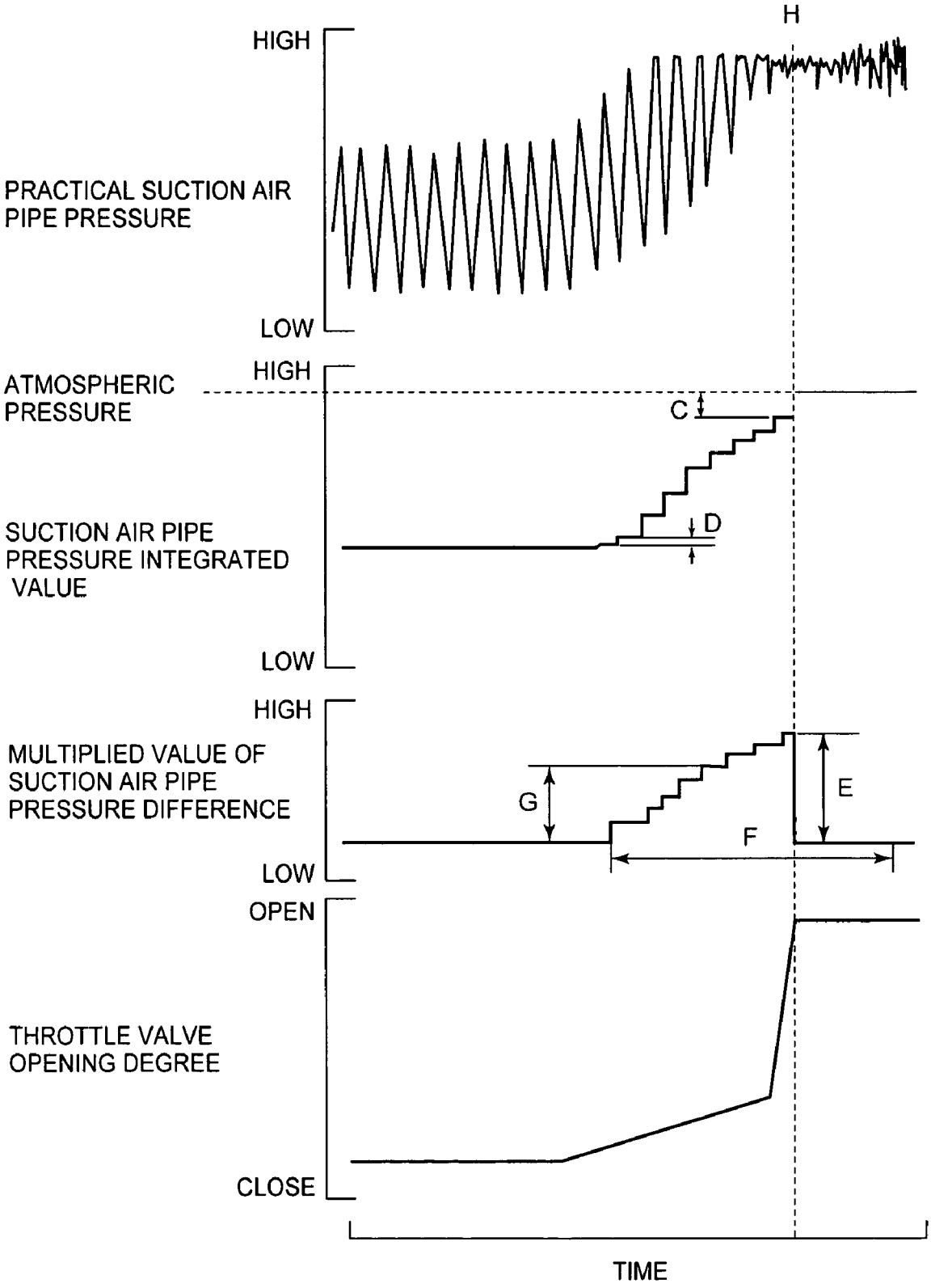
FIG. 2 is a graph for comparing a fluctuation of a suction air pipe pressure and each of data corresponding to the fluctuation in the present embodiment.

Next, a description will be given of details of a fuel injection control method for the engine executed by the electronic control unit 10, by explaining an operation of the fuel supply system 1 in accordance with the present embodiment by using graphs in FIGS. 2 to 4.

Figure 4:
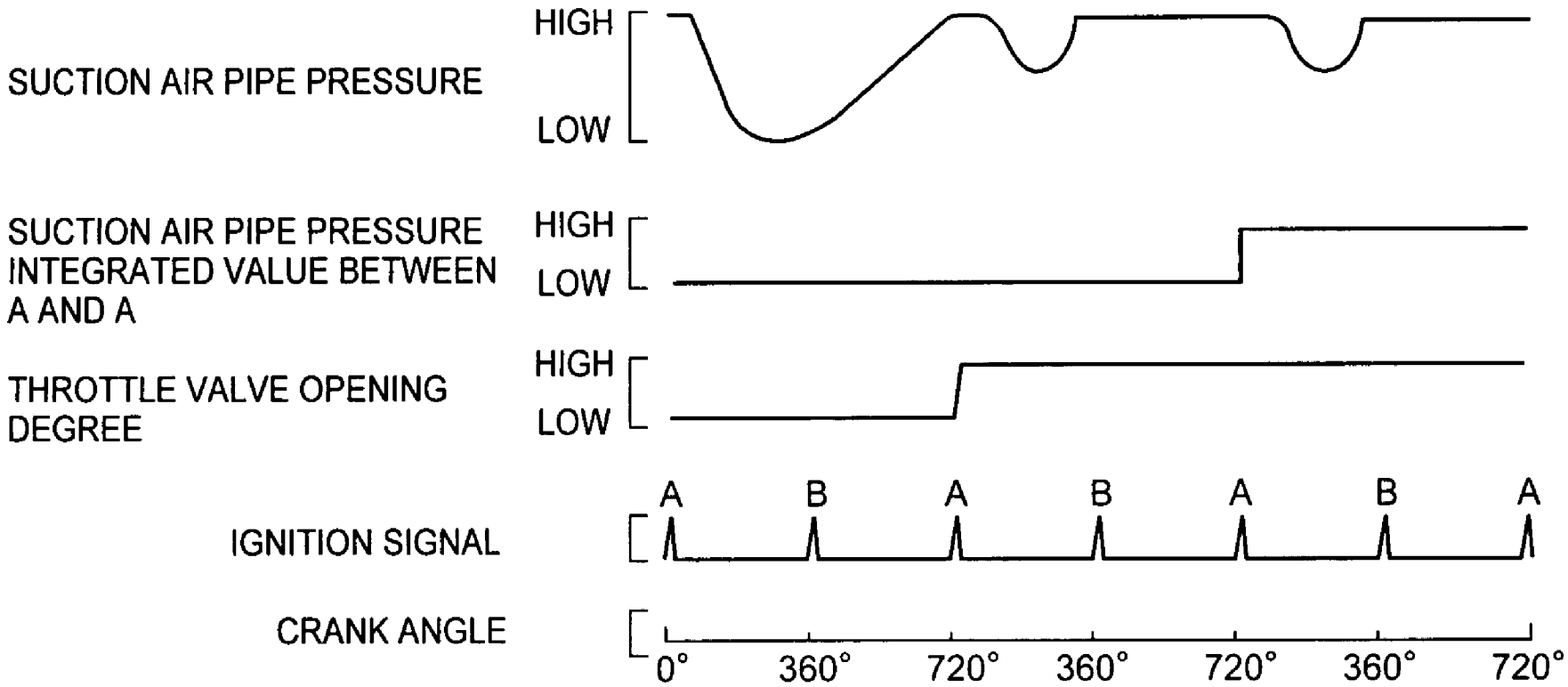
FIG. 4 is a graph displaying a detected suction air pipe pressure in correspondence to a crank angle in embodiment in accordance with the present invention.

FIG. 4 is a graph displaying in correspondence to the crank angle position detected by the ignition coil 12 serving as the crank position detecting means, in connection to the suction air pipe pressure which the electronic control unit 10 detects on the basis of the output signal of the pressure sensor 11 in the present embodiment. Further, for example, one combustion cycle from 0 degree to 720 degree (0 degree) is set as an A—A system, one combustion cycle from 360 degree to 360 degree is set as a B—B system, an integrated value of the suction air pipe pressure per one combustion cycle is calculated by two systems of combustion cycles, and a pressure integrated value of the A—A system is displayed below the graph of the suction air pipe pressure.

When the driver operates an accelerator pedal so as to open the throttle valve 32, the engine 2 is accelerated, however, since the throttle valve 32 is open, an increase width of a negative pressure becomes smaller. Accordingly, the apparatus mentioned above, there is a risk that a response delay is generated and an air-fuel mixture becomes lean or rich in the case that the throttle valve 32 suddenly moves and a suction air amount largely fluctuates.

Accordingly, a pressure integrated value of the suction air pipe is calculated with respect to one combustion cycle of the engine and is compared with the pressure integrated value at the preceding time, the acceleration is determined in the case that a difference equal to or more than a previously determined acceleration determining reference value, and a control of increasing a fuel injection amount is executed in correspondence to the pressure difference, and this portion is approximately in common with the conventional fuel injection control method mentioned above.

Figure 3:
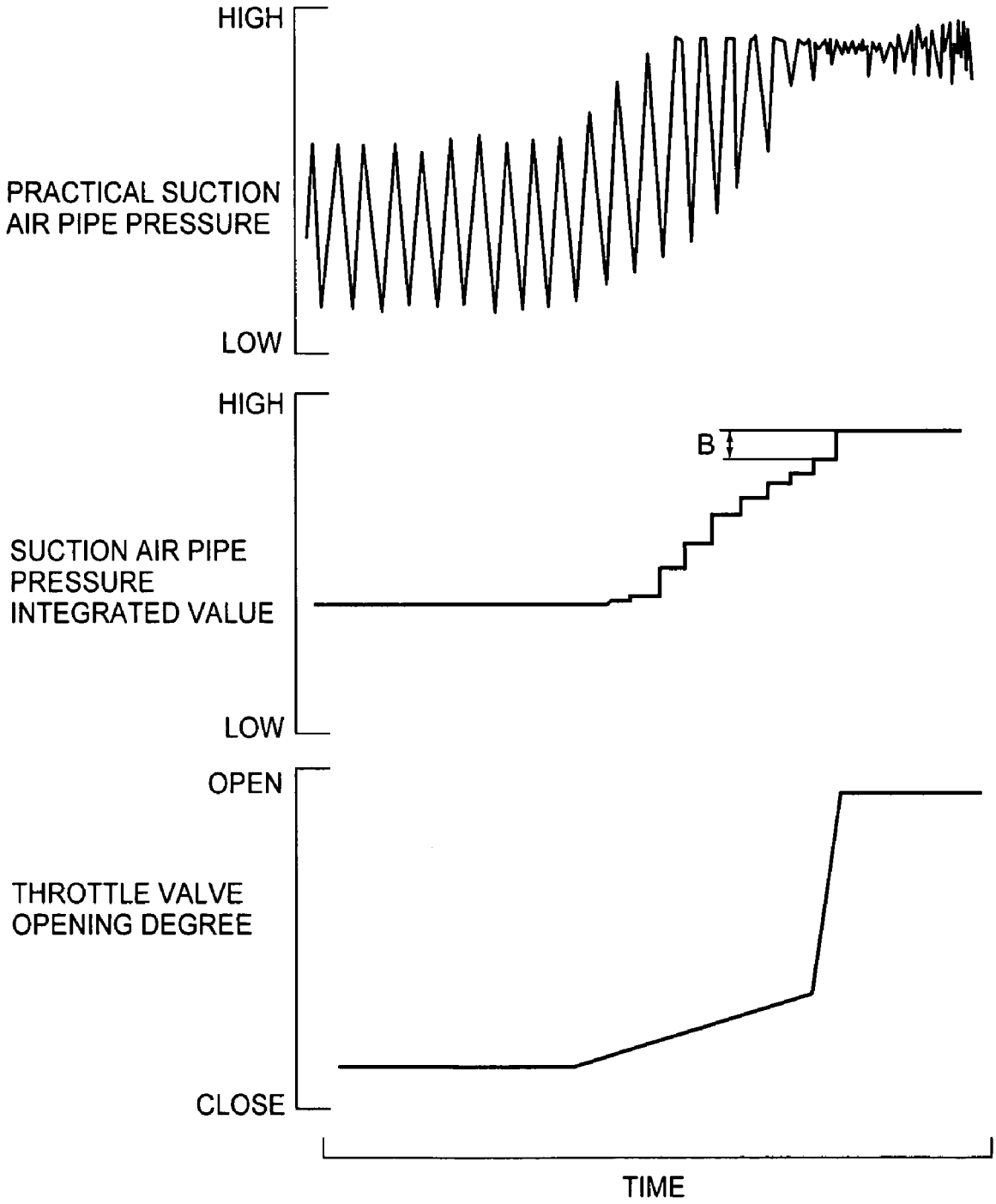
FIG. 3 is a graph for comparing a fluctuation of a suction air pipe pressure and each of data corresponding to the fluctuation in the prior art.

However, in the conventional determining method, in the case that the rapid acceleration is executed during the slow acceleration as shown in FIG. 3, or the like, the pressure difference B does not reach the previously determined acceleration determining reference value. Accordingly, since the determination of the acceleration is not executed and the control of increasing the fuel injection amount is not executed, the air-fuel ratio becomes lean and a trouble such as an engine breathing or the like is caused.

Accordingly, in the present invention, during a period when the pressure difference D does not reach the reference amount mentioned above as shown in FIG. 2, the electronic control unit 10 integrates the pressure difference over a previously determined integrating period F. Further, the integrated value is reset if the time goes beyond the integrating period F, and the integration is again executed.

Further, a predetermined level of acceleration (a rapid acceleration) state is determined at a time point H when the pressure difference integrated value becomes equal to or more than a reference value G and a difference between the pressure integrated value of the suction air pipe and the atmospheric pressure detected by the atmospheric pressure detecting means becomes equal to or less than a previously determined reference value C, a fuel injection amount is calculated in accordance with a predetermined calculating method on the basis of a pressure difference integrated value E at that time point, and a fuel amount increasing control is executed (in this case, the integrated value is reset at the time point when the acceleration is determined).

In accordance with the structure mentioned above, it is possible to properly maintain the air-fuel ratio by accurately determining the accelerated state even if the accelerated state is hard to be reflected to the pressure difference, and increasing the fuel injection amount to a necessary fuel injection amount. In this case, since a cost is increased if the atmospheric pressure detecting means is provided with an exclusive detecting apparatus, the atmospheric pressure detecting means utilizes the pressure sensor 11 arranged in the suction air pipe path 3, and the suction air pipe pressure within a predetermined time from a key switch ON time may be detected as a similar atmospheric pressure.

In the case of executing the control mentioned above, there is a risk that the rapid acceleration is erroneously determined even at a normal slow accelerating time, and the air-fuel ratio becomes rich. However, a certain degree of period is required in the normal slow accelerating time until a difference between the pressure integrated value and the atmospheric pressure becomes equal to or less than the reference value C, and the integrated value is reset over the difference integrating period F. Accordingly, the acceleration determination is not executed.

Further, in the case that so much period is not required until the difference from the atmospheric pressure becomes equal to or less than the reference value C, in a state in which the pressure integrated value of the suction air pipe is increased to a certain level, the pressure difference integrated value does not become equal to or more than the reference value G. Accordingly, the acceleration determination is not executed in this case. Therefore, the control in the fuel injection control method in accordance with the present invention is actuated only at the rapid accelerating time which is necessary to be corresponded during the slow acceleration, and it is possible to execute an optimum fuel amount increase.

As mentioned above, on the basis of the present embodiment using the fuel injection control apparatus for the engine structured such that the detecting means embedded in the engine is used, and the program for executing the fuel injection control method mentioned above is installed in the general-purpose electronic control unit, it is possible to execute the accurate engine air-fuel ratio control in correspondence to all the accelerated states without accompanying the excessive cost increase.

What is claimed is:

1. A fuel injection control method for an engine in which an electronic control unit calculating a pressure integrated value for one combustion cycle by detecting a combustion cycle by a crank angle detecting means and continuously detecting a suction air pipe pressure by a suction air pipe pressure detecting means determines that the engine is under an accelerated state in the case that a pressure difference determined by comparing said pressure integrated value with said pressure integrated value at the preceding time becomes equal to or more than a predetermined acceleration determining reference value, thereby increasing a fuel amount, wherein said fuel supply system is provided with an atmospheric pressure detecting means, and executes an acceleration determination that the engine is under the accelerated state in said electronic control unit in the case that a difference between said pressure integrated value and the atmospheric pressure detected by said atmospheric pressure detecting means is equal to or less than a predetermined reference value, and a pressure difference multiplied value obtained by multiplying said pressure difference within a predetermined multiplying period including this time combustion cycle is equal to or more than a predetermined reference value, even if said calculated pressure value is less than said acceleration determining reference value.

2. A fuel injection control method of an engine as claimed in claim 1, the calculation of the fuel injection amount in the case that said electronic control unit executes said acceleration determination is executed in accordance with a predetermined calculating method on the basis of said pressure difference integrated value at a time point when the acceleration is determined.

3. A fuel injection control apparatus for an engine comprising an electronic control unit in which a program for executing a fuel injection control method of the engine is stored in a memory means, wherein the fuel injection control apparatus is incorporated in said fuel supply system of the engine so as to execute the fuel injection control method of the engine as claimed in claim 1 or 2.

* * * * *